US011259660B2

(12) United States Patent
Rees

(10) Patent No.: US 11,259,660 B2
(45) Date of Patent: Mar. 1, 2022

(54) NON-SPILL DRINKING VESSEL

(71) Applicant: THE CREATIVE ONE LTD, Hong Kong (CN)

(72) Inventor: Arnold Rees, Newcastle Upon Tyne (GB)

(73) Assignee: The Creative One Ltd., Hong Kong (CN)

( * ) Notice: Subject to any disclaimer, the term of this patent is extended or adjusted under 35 U.S.C. 154(b) by 294 days.

(21) Appl. No.: 16/331,630

(22) PCT Filed: Sep. 18, 2017

(86) PCT No.: PCT/GB2017/052753
§ 371 (c)(1),
(2) Date: Mar. 8, 2019

(87) PCT Pub. No.: WO2018/051126
PCT Pub. Date: Mar. 22, 2018

(65) Prior Publication Data

US 2019/0357708 A1 Nov. 28, 2019

(30) Foreign Application Priority Data

Sep. 19, 2016 (GB) ..... 1615891

(51) Int. Cl.
*A47G 19/22* (2006.01)
*B65D 51/16* (2006.01)

(52) U.S. Cl.
CPC ..... *A47G 19/2272* (2013.01); *B65D 51/165* (2013.01); *A47G 19/2227* (2013.01)

(58) Field of Classification Search
CPC ..... A47G 19/2272; B65D 47/2031; B65D 51/165
See application file for complete search history.

(56) References Cited

U.S. PATENT DOCUMENTS 5,607,073 A 3/1997 Forrer
5,706,973 A 1/1998 Robbins, III et al.
(Continued)

FOREIGN PATENT DOCUMENTS

FR 2992047 A1 12/2013
GB 2266045 A 10/1993
(Continued)

OTHER PUBLICATIONS

Longo Dit Operti, T., "International Search Report," prepared for PCT/GB2017/052753, dated Nov. 29, 2017, five pages.

*Primary Examiner* — Mollie Impink
(74) *Attorney, Agent, or Firm* — Burr & Forman, LLP

(57) ABSTRACT

A non-spill drinking cup valve system (10) comprises a lid assembly (12) and a flexible valve member (14). The flexible valve member (14) is removably attachable to the lid assembly (12). The lid assembly (12) comprises a spout (16) having a drinking aperture (18) therein. The flexible valve member (14) comprises a protruding member (26) having a tip (52) and a drinking valve element (28) in the tip (52), which, in use, controls fluid flow into the spout (16) and out of the drinking aperture (18). The protruding member (26) and the spout (16) are of a complementary shape and, when the lid assembly (12) and the flexible valve member (14) are attached together, the protruding member (26) extends substantially into the spout (16).

22 Claims, 15 Drawing Sheets

(56) References Cited

U.S. PATENT DOCUMENTS

| | | | | |
|---|---|---|---|---|
| 5,890,619 | A | 4/1999 | Belanger | |
| 5,893,472 | A | 4/1999 | Forrer | |
| 6,357,620 | B1 * | 3/2002 | Hakim | B65D 43/0231 220/714 |
| 6,758,364 | B1 | 7/2004 | Rohrig | |
| 2002/0033399 | A1 | 3/2002 | Manganiello et al. | |
| 2003/0222238 | A1 | 12/2003 | Getzewich et al. | |
| 2004/0245260 | A1 * | 12/2004 | Rohr | B65D 51/165 220/785 |
| 2005/0072788 | A1 * | 4/2005 | Lieberman | F16K 15/147 220/714 |
| 2011/0056968 | A1 * | 3/2011 | McNamara | A47G 19/2272 220/714 |
| 2011/0089178 | A1 | 4/2011 | Giraud et al. | |
| 2014/0252012 | A1 | 9/2014 | Wharton | |
| 2014/0252013 | A1 * | 9/2014 | Coyle | A47G 19/2272 220/714 |
| 2017/0066567 | A1 * | 3/2017 | Chen | A47G 19/2272 |

FOREIGN PATENT DOCUMENTS

| | | | | |
|---|---|---|---|---|
| WO | WO-0197663 | A1 * | 12/2001 | A47G 19/2272 |
| WO | WO-2014086625 | A1 | 6/2014 | |

* cited by examiner

NON-SPILL DRINKING VESSEL

This invention relates generally to improvements in a non-spill drinking cup valve system, which comprises a lid assembly and a flexible valve member. In particular, the invention relates to improvements in a non-spill drinking vessel, which comprises a cup base, a lid assembly and a flexible valve member.

INTRODUCTION

Non-spill drinking vessels, typically cups, of the valved type are often the product of choice for parents with infants transitioning from breast or bottle feeding, as they tend to reduce or prevent spillage and messy stains that can result from water and specialist infant juices. Such non-spill drinking cups have a valve with a seal provided between the lid and the cup, the valve opening under applied suction by the user.

Types of valve in common use in drinking cups for infants are those which incorporate the use of flexible valve member having a slit, which can be flat, concave, or convex in shape. However, such valve designs all require relatively high suction levels to open the slit and allow the liquid to flow.

One disadvantage of some current valve designs is that the valve opens in the direction of liquid flow under very low suction levels, to allow the infant to drink with ease. However, the valve also opens relatively easily and results in spillage from the cup when transporting the cup for later use by the infant.

To overcome this problem, concave shaped valves are therefore more frequently used, which typically require a higher level of onset suction. The main disadvantage of concave shaped valves is that the higher level of suction, such as, for example suction of 70 mbar or above, is required to overcome the concave profile before opening the slit. This translates into an instant high liquid flow, which does not give the user any sensitive control over the onset flow rate. This puts the infant at greater risk of ingesting air before liquid begins to flow from the cup, which can lead to painful wind and colic. Furthermore, infants exposed to higher levels of suction during feeding are known to be at greater risk of developing another painful medical condition known as 'glue-ear'.

Typical valve designs also include those in which the valve element is permanently enclosed and sealed inside a rigid casing. However, the user cannot take apart or disassemble such valves for cleaning and, as such, cannot hygienically clean the valve. Indeed, liquid or moisture trapped inside these types of valves grow bacteria and are therefore also undesirable.

The invention aims to obviate or mitigate one or more disadvantages associated with current non-spill drinking valves and non-spill drinking vessels.

SUMMARY OF INVENTION

According to a first aspect. there is provided, a non-spill drinking cup valve system comprising: a lid assembly and a flexible valve member, wherein the flexible valve member is removably attachable to the lid assembly, the lid assembly comprising a spout having a drinking aperture therein; the flexible valve member comprising a protruding member having a tip and a drinking valve element in the tip, which, in use, controls fluid flow into the spout and out of the drinking aperture; wherein the protruding member and the spout are of a complementary shape and, when the lid assembly and the flexible valve member are attached together, the protruding member extends substantially into the spout.

Preferably, the protruding member extends into the spout such that there is a minimum clearance between the tip and the spout.

Further preferably, the spout and the protruding member are generally elongate with generally rounded or convex tips. This means that the drinking valve element is generally convex shaped.

The drinking valve element may be a drinking valve slit which may open in a direction of an applied suction when a user applies suction to the spout. The drinking valve slit may open under a suction of less than 50 mbar. Preferably, the slit opens under a suction of 15-40 mbar. The drinking valve slit may be between 5-10 mm in length.

The flexible valve member may further comprise one or more compression pads, wherein the one or more compression pads engage an inner wall of the spout.

The lid assembly may comprise a locating boss, the flexible valve member may comprise a boss receiving member and, when the lid assembly and the flexible valve member are attached together, the boss receiving member may frictionally engage the locating boss.

The system may further comprise a valve retaining member.

The lid assembly may comprise one or more posts and the flexible valve member may comprise one or more corresponding holes for receiving the posts thereby to locate the flexible valve member.

The flexible valve member may further comprise a flexible lip seal, wherein the flexible lip seal may frictionally engage the inner surface of the lid assembly.

The flexible valve member may further comprise a sealing rib.

The flexible valve member may further comprise an integral removal tab.

The flexible valve member may comprise silicone or thermoplastic elastomer which may have a Shore A hardness between 20 and 50.

The lid assembly may comprise a food-contact approved thermoplastic polyolefin such as polypropylene, polyethylene, or a combination thereof.

The locating boss may have a venting aperture located therein and the boss receiving member may comprise a venting valve element which, when the lid assembly and the flexible valve member are attached together, may be in fluid communication with the venting aperture. The venting valve element may be a venting valve slit.

There is further provided a drinking vessel comprising the drinking cup valve system of the first aspect and a cup base. The lid assembly and the cup base may be secured by a screw thread, or the lid assembly and the cup base may be secured by a push-fit or clip-fit. The cup base may comprise a handle.

BRIEF DESCRIPTION OF DRAWINGS

The accompanying drawings illustrate presently exemplary embodiments of the disclosure, and together with the general description given above and the detailed description of the embodiments given below, serve to explain, by way of example only, the principles of the disclosure. In the accompanying drawings.

DETAILED DESCRIPTION

Figure 2:
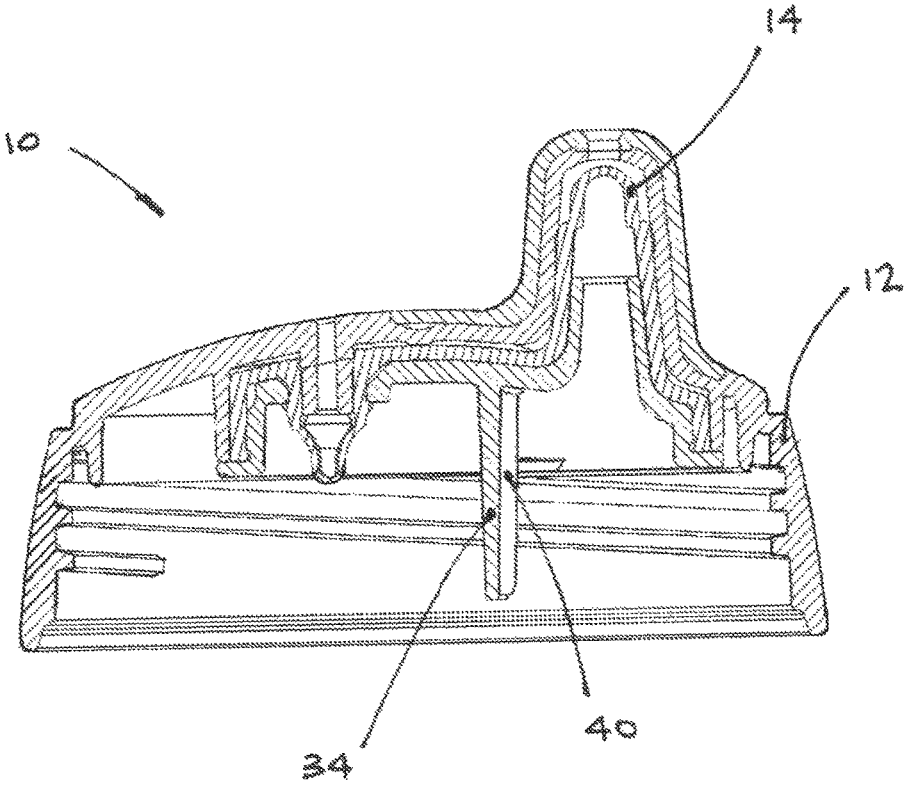
FIG. 2 shows a sectional view of a non-spill drinking cup valve system according to an embodiment of the invention.

Referring now to FIG. 2, a non-spill drinking cup valve system 10 comprises a lid assembly 12 and a flexible valve member 14, the flexible valve member 14 being removably attached to the underside of the lid assembly 12.

Figure 2A:
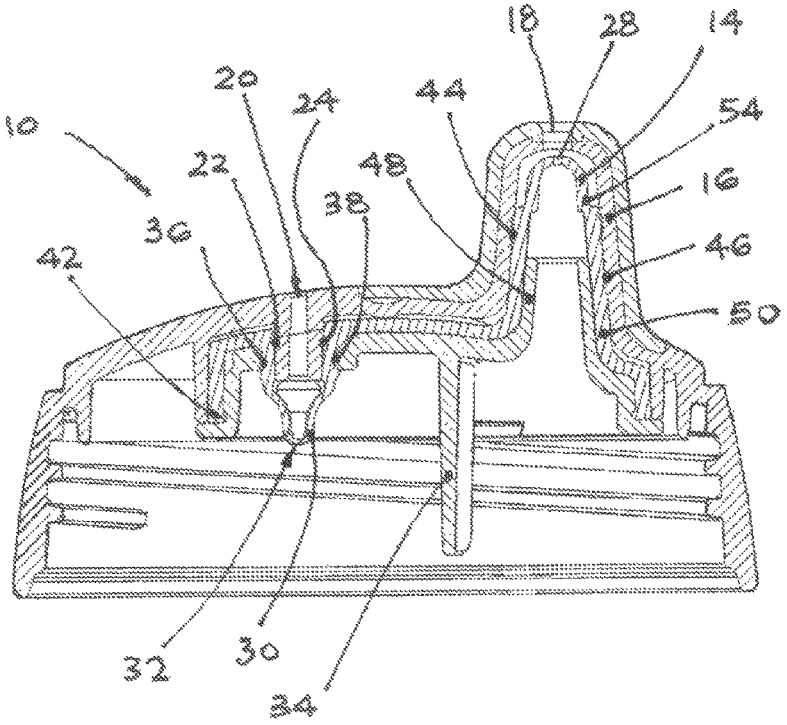
FIG. 2A shows a detailed view of FIG. 2.

As shown best in FIG. 2A, the lid assembly 12 comprises a spout 16 having a drinking aperture 18 therein, and a locating boss 22 having a cylindrical outer wall 24 extending outwardly from the lid assembly 12. The lid assembly 12 also comprises a venting aperture 20 positioned within the locating boss 22, the aperture 20 formed by the cylindrical outer wall 24.

Figure 3:
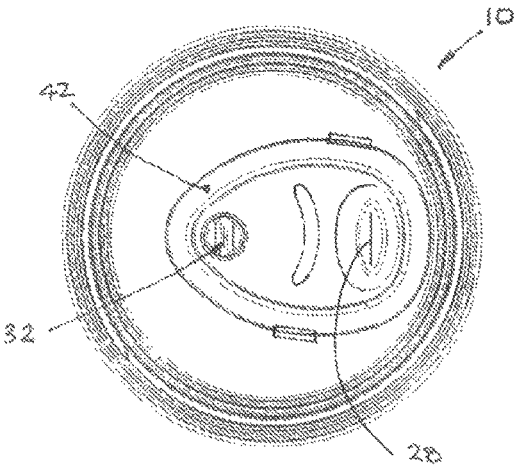
FIG. 3 shows a bottom orthographic view of the lid assembly and valve means of FIG. 2.
Figure 4:
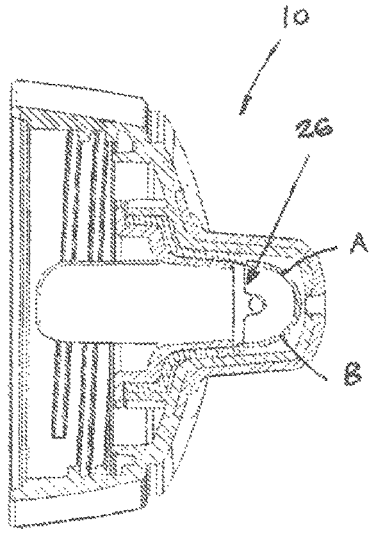
FIG. 4 shows another sectional view of the lid assembly and valve means of FIG. 2.
Figure 5A:
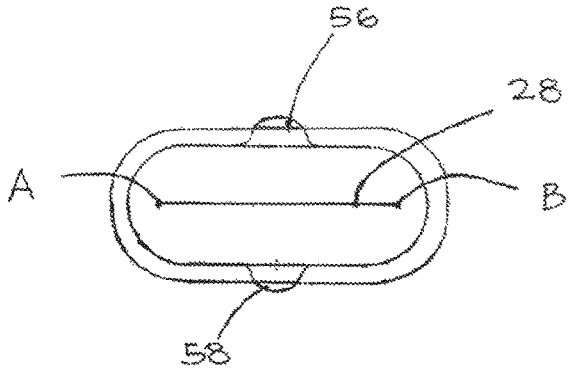
FIGS. 5, 5A and 6 show enlarged orthographic views of the valve means of FIG. 2.
Figure 5:
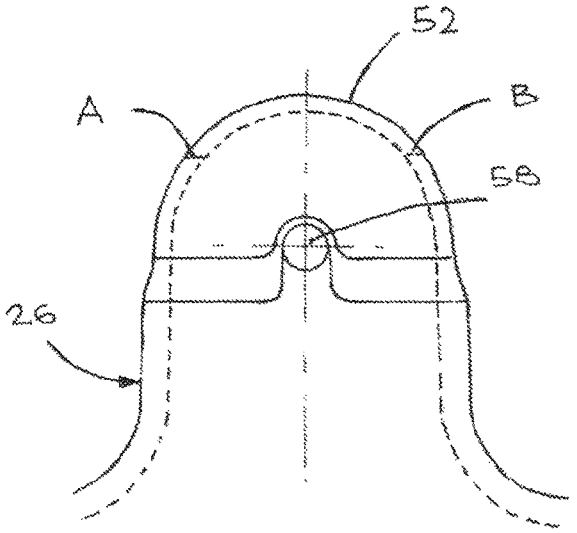
Figure 6:
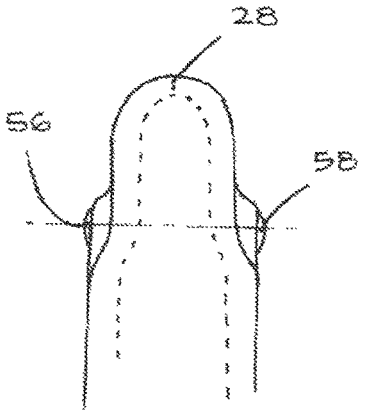
Figure 7:
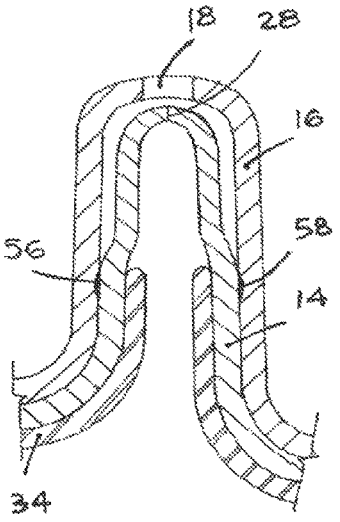
FIGS. 7 and 8 show enlarged sectional views of the lid assembly, valve means and retaining member of FIG. 2.
Figure 8:
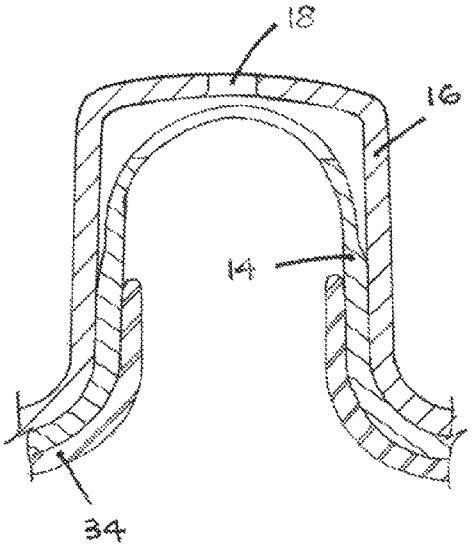

With reference to FIGS. 2A, 3 and 4, the flexible valve member 14 comprises a protruding member 26 (see FIG. 5) whose shape is complementary to the shape of the spout 16. Preferably, the protruding member 26 and the spout are both generally elongate with generally rounded or convex tips. The protruding member 26 has a tip 52 which will be further discussed hereinafter. The protruding member 26 extends substantially into the spout 16. The protruding member 26 frictionally engages the inner wall 44 of the spout 16. In the tip 52 of the protruding member 26, there is a drinking valve element 28 which, in use, controls fluid flow into the spout 16 and out through the drinking aperture 18. Because the tip 52 is generally convex shaped, the drinking valve element 28 is generally arcuate or curved. The flexible valve member 14 also has a boss receiving member 30 having a venting valve element 32. The drinking valve element 28 and venting valve element 32 are slits, though other appropriate valve elements may be considered by those skilled in the art.

The drinking cup valve system 10 further comprises a valve retaining member 34. The valve retaining member 34 comprises a cylindrical wall 36 forming an aperture 38, the aperture 38 being configured to receive the boss receiving member 30 and locating boss 22 therethrough. The valve retaining member 34 also comprises a removal tab 40 (see FIG. 2), to aid in disassembly and cleaning of the flexible valve member 14.

The flexible valve member is preferably made from silicone or thermoplastic rubber with a Shore A hardness of between 20 and 50. The lid member is preferably made from food-contact approved thermoplastic polyolefin such as polypropylene, polyethylene or a combination thereof.

The flexible valve member 14 is assembled to the valve retaining member 34 by way of a retaining rib 42, which runs around the inner circumference of the flexible valve member 14. Once the flexible valve member 14 is positioned upon retaining rib 42, the retaining member 34 can be pressed into the underside of the lid assembly 12. The flexible valve member 14 is retained in position by way of compression between the lid assembly 12 and the valve retaining member 34. This compression results in a liquid seal between an inner wall 44, 46 of the spout 16, and an outer wall 48, 50 of the valve retaining member 34, by circumferential compression of the flexible valve member 14 therebetween.

Similarly, as shown best in FIG. 2A, a liquid seal is produced circumferentially at the boss receiving member 30 of the flexible valve member 14, between the outer cylindrical wall 24 of the locating boss 22, and the cylindrical wall 36 of the valve retaining member 34.

As already mentioned, the protruding member 26 and the spout 16 are preferably of complementary shape. That is to say, the profile of the outer surface of the protruding member 26 preferably follows the profile of the inner surface of the spout 16. What is more, the protruding member 26 may extend into the spout such that there is only a small clearance 54 between the outer surface of the protruding member 26 and the inner surface of the spout 16. This clearance 54 is necessary to allow the drinking valve slit 28 to open in the clearance 54 when suction is applied to the spout 16. The clearance 54 is kept to a minimum, that is to say, it is substantially only as wide as is required for the valve slit 28 to open, to reduce the potential volume of liquid which may become trapped between the flexible valve member 14 and the spout 16 when drinking. The boss receiving member 30, having the venting valve element 32, allows pressure-equalizing airflow into the cup when drinking.

With reference to FIGS. 2A and 4, the generally curved drinking valve slit 28 extends between points A and B. The liquid flow-rate through the drinking valve slit 28, when in the open position, is controlled by the length of the slit 28 between points A and B. A shorter length of slit 28 reduces the liquid flow rate through the flexible valve member 14 and makes drinking more difficult, whilst increasing the slit 28 in length increases the liquid flow rate and makes drinking easier. The flow rate is controlled by the size of drinking aperture 18 (see FIG. 2A), in the end of the spout 16 and the suction applied thereto. The valve flow rate must be responsive enough to maintain adequate flow through the drinking aperture 18. Preferably, the drinking valve slit 28 has a length, between points A and B, of 5-10 mm to provide the correct valve function.

As shown in FIGS. 5-8, in order to maintain a pressurized seal of the drinking valve 28 for the purpose of preventing leakage, the flexible valve member 14 may further comprise two centrally positioned compression pads 56, 58. The compression pads 56, 58 apply pressure to side walls 60*a*, 60*b* (see FIGS. 10 and 11) of the drinking valve slit 28 when no suction is applied to the spout 16. In this way the slit 28 is maintained in the closed position and maintains the liquid seal. The positioning of the compression pads 56, 58 is preferable to the functioning of the drinking valve slit 28, for both ease of drinking and also for providing adequate compression for sealing the drinking valve slit 28 closed to avoid accidental spills. The compression pads 56, 58 are shown centrally positioned from the radial valve outer curve 52 in FIG. 5.

As already mentioned, the tips of the protruding member and the spout are both generally convex in shape. Another way of describing their shape would be to say that they are both generally semi-circular or outwardly curved in both cross-sectional views. This is to ensure that the negative pressure generated in the clearance area 54, between the flexible valve member 14 and the spout 16 (see FIG. 2A), acts on the largest possible surface area of the flexible valve member 14. In doing so, the invention ensures an optimum flow rate is achieved through minimum suction, when the drinking valve slit 28 opens.

Figure 9:
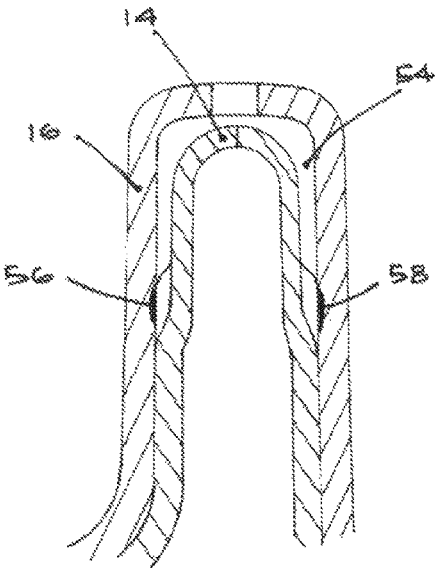
FIGS. 9 and 10 show enlarged sectional views of the lid assembly and valve means of FIG. 2.
Figure 10:
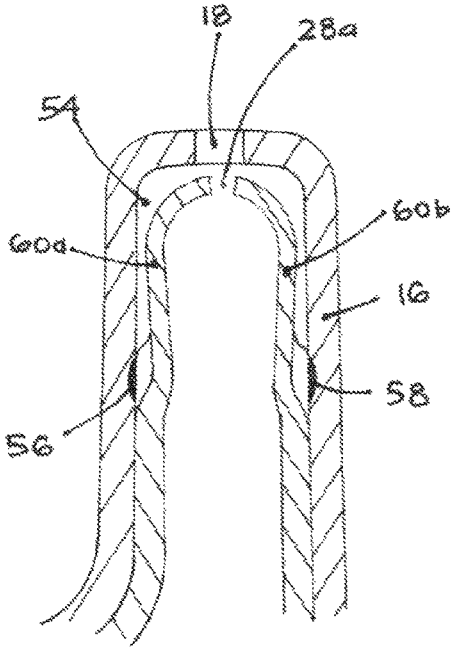

The flexible valve member 14 is shown at rest, with the drinking valve slit 28 in the closed position in FIG. 9. Note that the compression pads 56, 58 are indicated but not shown in compression. When suction is applied to the spout 16, as shown in FIG. 10, negative pressure (vacuum) builds up in the area 54, between the flexible valve member 14 and the inside of the spout 16. This increase in vacuum results in a net outward acting force exerted on the side walls 60*a*, 60*b* of the flexible valve member 14, thereby opening the drinking valve slit 28 into an open position 28*a*, allowing liquid to flow through the drinking aperture 18. The tip 52 (see FIG. 9) is generally convex in shape and compression pads 56, 58, are used, rather than the tip being concave, as is often used in drinking cup valves to maintain a positive seal.

In the present invention, where the tip 52 of the protruding member 26 is generally convex in shape and the drinking valve slit 28 is generally curved, the user has far more control of the flow rate as the drinking valve slit 28 opens under much lower suction values, typically less than 50 mbar and preferably between 15-40 mbar. The flexible valve member 14, with the drinking valve slit 28 requiring lower onset suction to open, has benefits for the infant, as it reduces the air ingestion while drinking and is therefore a much more comfortable experience for the child.

More importantly, since drinking is easier the infant will be better hydrated than through those cups requiring higher suction levels to obtain flow. It will be understood that those cups which require higher onset suction levels to open the valve also close earlier, towards the end of the suck cycle, thus reducing the volume of liquid taken during each suck cycle.

Figure 11:
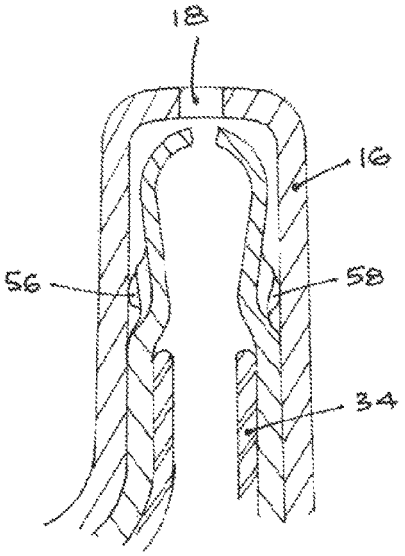
FIGS. 11 and 12 show enlarged sectional views of the lid assembly, valve means and retaining member of FIG. 2.

FIG. 11 shows the distortion created around the flexible valve member 14 and how the flexible valve member 14 appears with the drinking valve slit 28 in the open (i.e. drinking) position when suction is applied to the spout 16.

Ensuring that an adequate seal is produced when the drinking valve slit 28 is in the closed position is necessary for transportation and also to avoid spills. It has already been described how, through the use of compression pads 56, 58 of the flexible valve member 14, the side walls 60*a*, 60*b* of the valve member 14 are compressed together to maintain an adequate liquid seal—a prerequisite for such a non-spill drinking vessel.

Figure 12A:
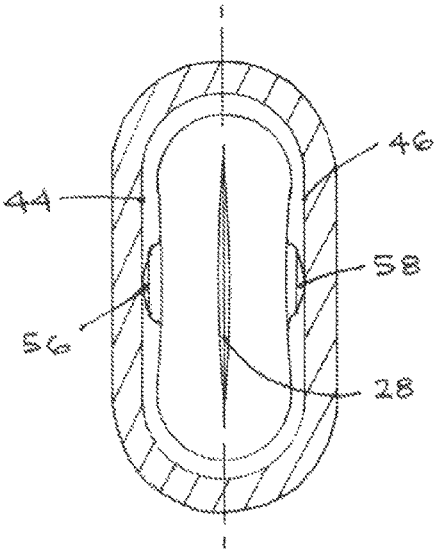
FIG. 12A shows a sectional view of the valve means of FIG. 12 along the line X-X.
Figure 12:
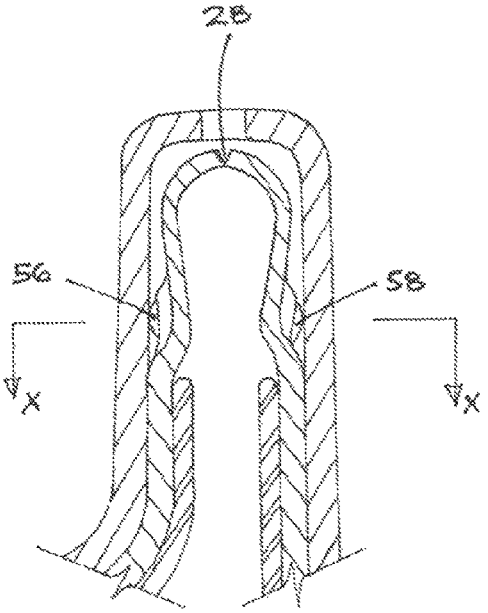

As shown in FIGS. 12 and 12A, the flexible valve member 14 is distorted when the compression pads 56, 58 are in contact with the inner walls 44, 46 of the spout 16 when no suction is applied. With particular reference to FIG. 12A, when the compression pads 56, 58 force the side walls 60*a*, 60*b* (see FIGS. 10 and 11) of the drinking valve slit 28 inwardly, this distortion then opens the outer surface of the drinking valve slit 28, while the inner surface of the slit 28 remains closed under pressure from the compression pads 56, 58. Depending upon the level of interference compression upon compression pads 56, 58, it will be seen that with a lower level of interference compression the outer surface of the drinking valve slit 28 undergoes a pre-stressed peeling action. When higher levels of interference compression are applied, a 'vee-shape' is formed at the tip 52 of the drinking valve slit 28 resulting in a greatly reduced surface contact area towards the lower point of the 'vee-shape'. When the flexible valve member 14 is viewed from above (as shown in FIG. 12A), the slit 28 resembles a pair of lips. Given that the flexible valve member 14 is preferably made from silicone, the slit 28 tends to re-bond or "stick" together. The forming of the 'vee-shape' and/or pre-stressing at the outer surface of the drinking valve slit 28 is preferable for ease of drinking since it reduces the surface contact area of the outer surface of the drinking valve slit 28, thereby reducing this "sticking" effect, allowing the drinking valve slit 28 to open under lower suction forces.

It will be understood that the forces acting on the interior profile of the drinking valve slit 28 are in compression, whilst the exterior profile of the drinking valve slit 28 are in tension. The reduced surface contact area resulting from the 'veeshape' produced at the outer surface of the drinking valve slit 28 allows the wall thickness at the valve tip to be made generally thicker, more robust and therefore less susceptible to damage through assembly, disassembly, cleaning and if necessary sterilizing. The wall thickness of the outer radial curve 52 (see FIG. 5) may be in the region of 0.80 mm and capable of withstanding regular use and routine washing. It will be understood that smaller valve designs could be used, but would not be as responsive to opening.

Furthermore smaller valve designs would make it difficult to access all surfaces for cleaning and in turn would be liable to damage. To provide increased valve responsiveness, or ease of opening under suction, it would normally require the wall thickness at the valve slit to be much thinner i.e. approximately 0.40 mm. A thinner wall thickness will therefore be seen to be less desirable since the valve will be less robust and much more prone to accidental damage when in regular use.

Figure 13:
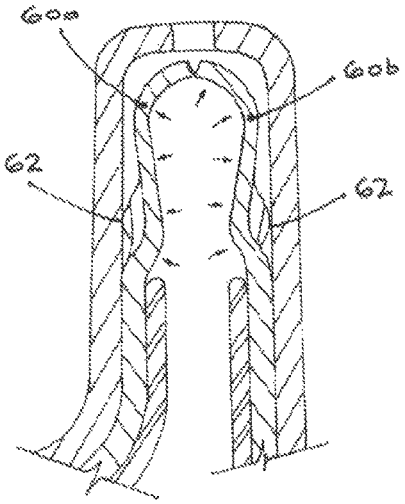
FIG. 13 shows a sectional view of the lid assembly, valve means and retaining member of FIG. 2.

As shown in FIG. 13, should the cup be accidentally knocked over or dropped, the kinetic energy transferred to the liquid inside the cup, indicated by arrows, will quickly fill the spout area and apply pressure to the side walls 60*a*, 60*b* of the flexible valve member 14. However it will be seen that pressure to the inside of the flexible valve member 14 acts both above and below a pivot point 62, created by the compression pads 56, 58 (not indicated in FIG. 13). The forces acting against the inside of the valve above the pivot point 62 act to open the drinking valve slit 28, whilst forces acting against the inside of the valve below the pivot point 62 act to maintain the drinking valve slit 28 in the closed position. This has been proven through the use of prototypes to be extremely effective in maintaining an efficient seal when the cup is inadvertently shaken.

It will be understood that in order to increase the sealing pressure, which may be required, e.g. for sealing warm liquid drinks or for occasions where there are fluctuations in the temperature of the liquid contained inside the cup, the height of the compression pads 56, 58 can be increased or adjusted, to achieve the sealing specification required.

With reference to FIGS. 14, 14A, 14B and 14C, there is described another non-spill drinking cup valve system 100 in which the flexible valve member 114 is a one-piece construction and thereby eliminates the need for an additional retaining member. Aside from the lack of a retaining member, the flexible valve member 114 may be substantially as described above, in relation to FIGS. 2-13.

Figure 14:
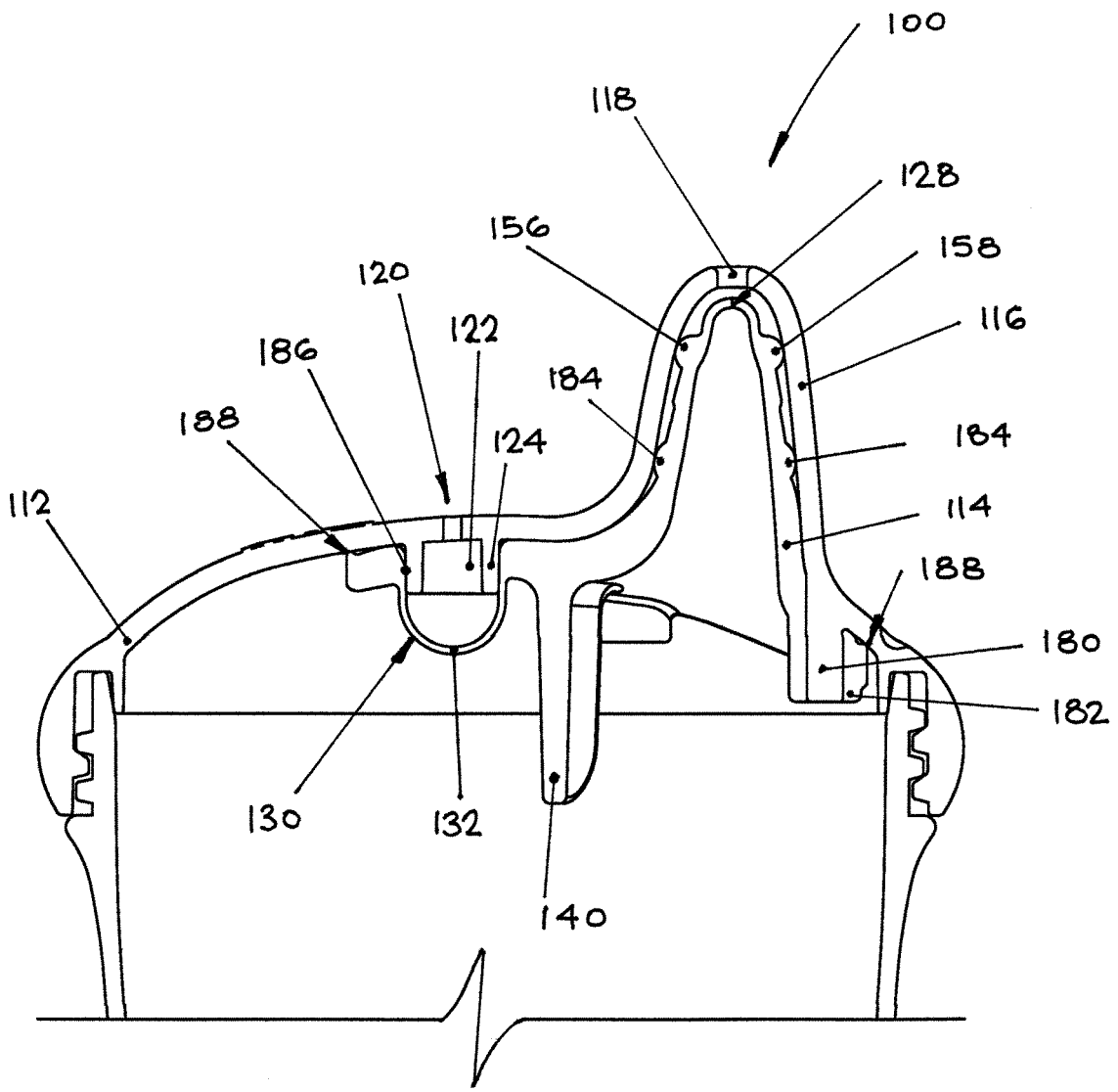
FIG. 14 shows a sectional view of a non-spill drinking cup valve system according to another embodiment of the invention.
Figure 14A:
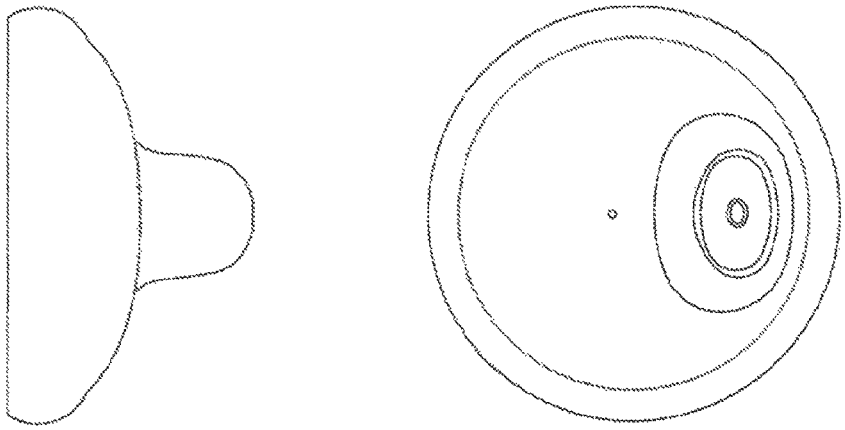
FIG. 14A shows orthographic and sectional views of the lid assembly of FIG. 14.
Figure 14A:
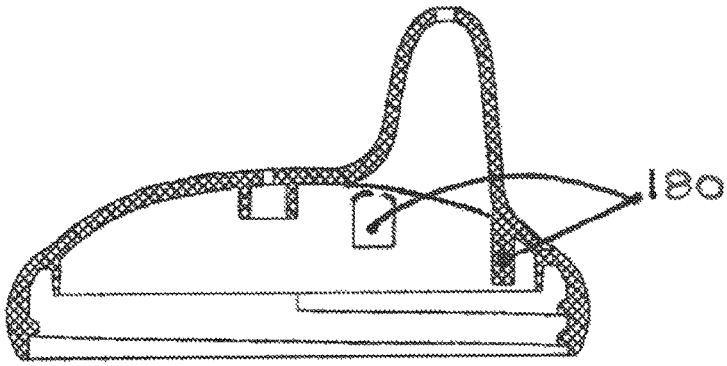
Figure 14A:
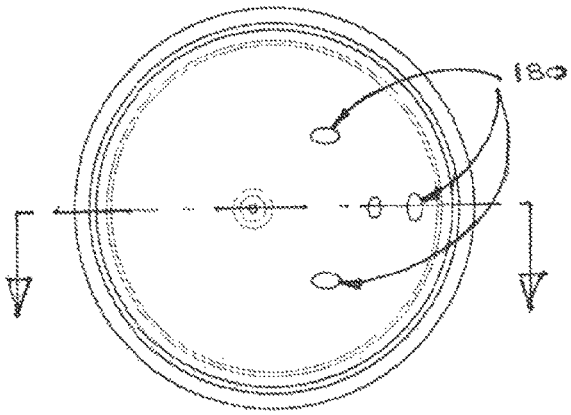
Figure 14B:
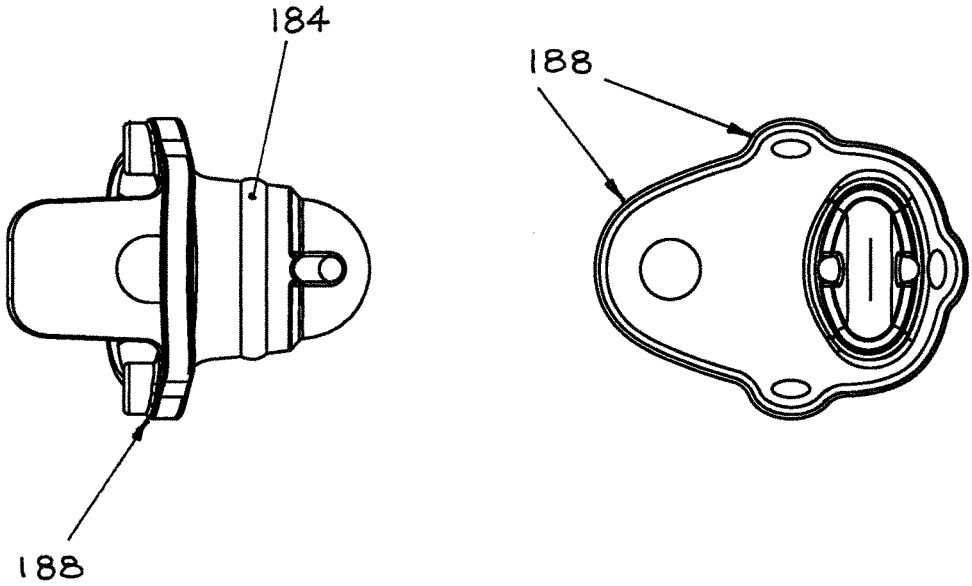
FIG. 14B shows orthographic and sectional views of the valve means of FIG. 14.
Figure 14B:
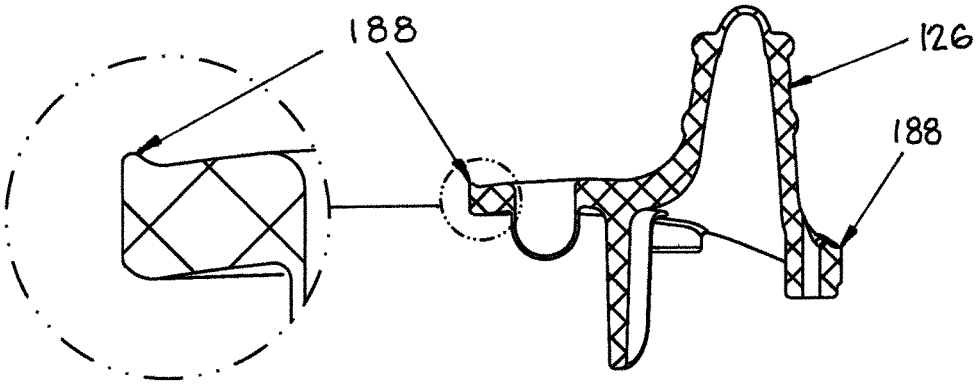
Figure 14B:
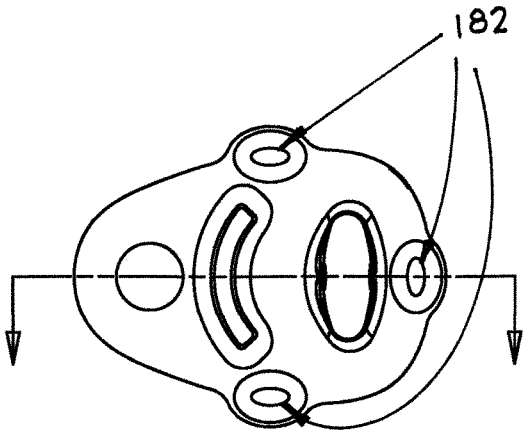

As shown in FIGS. 14-14B, the non-spill drinking cup valve system 100 comprises a lid assembly 112 and a flexible valve member 114. The lid assembly 112 comprises a spout 116 having a drinking aperture 118 therein, and a venting aperture 120. The lid assembly 112 also comprises a locating boss 122, formed by a cylindrical outer wall 124 extending outwardly from an inner side of the lid assembly 112.

The flexible valve member 114 comprises a protruding member 126 (see FIG. 14B) that may be complementary in shape to the spout 116 of the lid assembly 112. The flexible valve member also comprises a drinking valve element 128 located on the protruding member 126, and a boss receiving member 130 having a venting valve element 132. The drinking valve element 128 and the venting valve element 132 are slits, though other appropriate valve elements may be considered by those skilled in the art.

The protruding member 126 of the flexible valve member 114 may have the same features as described in relation to FIGS. 5-13. In particular, the flexible valve member 114 may comprise compressions pads 156, 158 (see FIG. 14, 14B) that form a seal about the inside of the spout 116.

The flexible valve member 114 also comprises an integral removal tab 140 to aid in disassembly and cleaning of the flexible valve member 114. This integral removal tab 140 reduces the number of parts required in the drinking cup valve system.

Figure 14C:
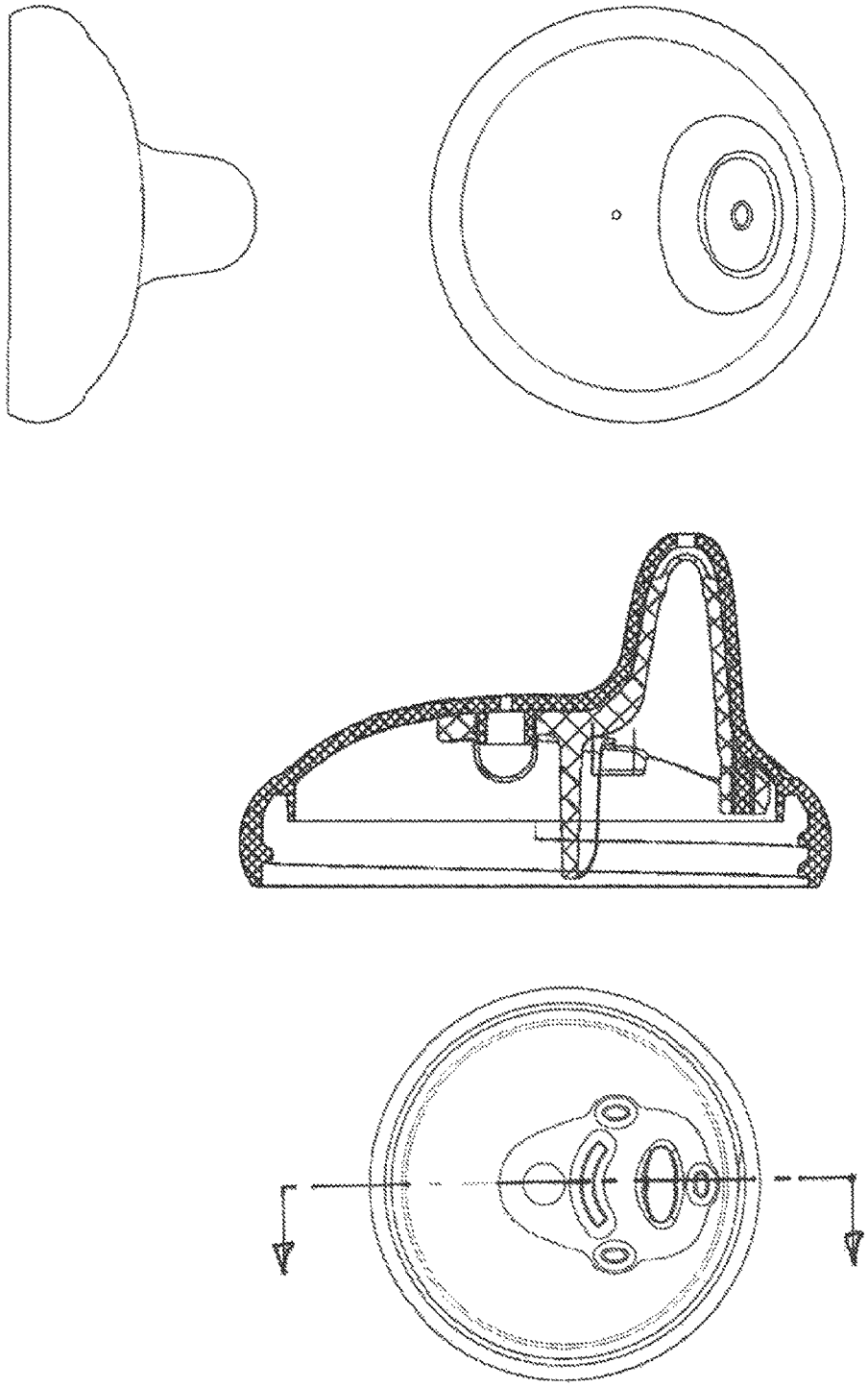
FIG. 14C shows orthographic and sectional views of the lid assembly and valve means of FIG. 14.

With reference to FIGS. 14-14C, the lid assembly 112 may comprise a plurality of downward facing locating posts, 180, shown as three oval shaped posts in the present embodiment. With further reference to FIG. 14B, the flexible valve member 114 may comprise a plurality of locating holes 182, shown as three oval shaped holes in the present embodiment, which are configured to frictionally engage the corresponding plurality of locating posts 180. The locating posts 180 and locating holes 182 are shown as oval shaped in the present embodiment, but other shapes may be considered suitable by the person skilled in the art. This configuration provides a secure fit between the lid assembly 112 and the flexible valve member 114, even when the cup is repeatedly dropped.

The flexible valve member 114 may also comprise one or more ribs 184 that form a seal around the interior lower portion of the spout 116 by frictional engagement of an inner wall of the spout 116 by the one or more ribs 184 of the flexible valve member 114.

With particular reference to FIGS. 14 and 14B, a seal 186 is formed around the venting valve 130 by frictionally engagement between the flexible valve member 114 and the cylindrical wall 124 of the locating boss 122. A further flexible lip seal 188 is formed around the outer profile of the flexible valve member 114 against the underside of the lid assembly 112 when in the assembled condition. The lip seal 188 has the benefit of reducing the ingress of liquid between the mating faces of the lid assembly 112 and the flexible valve member 114, which in turn reduces the likelihood of liquid forces acting on the seal created where the ribs 184 engage the spout 116, should the cup be accidentally dropped or shaken.

Embodiments of the present invention include benefits such as, in particular, ease of manufacture, since the flexible nature of the flexible valve member 14, 114, preferably made of silicone, is more tolerant of dimensional variations that may be present in the lid assembly 12, 112 and valve retaining member 34. Being very easy to disassemble, all surfaces can be visibly inspected, hygienically cleaned and reassembled.

Figure 1:
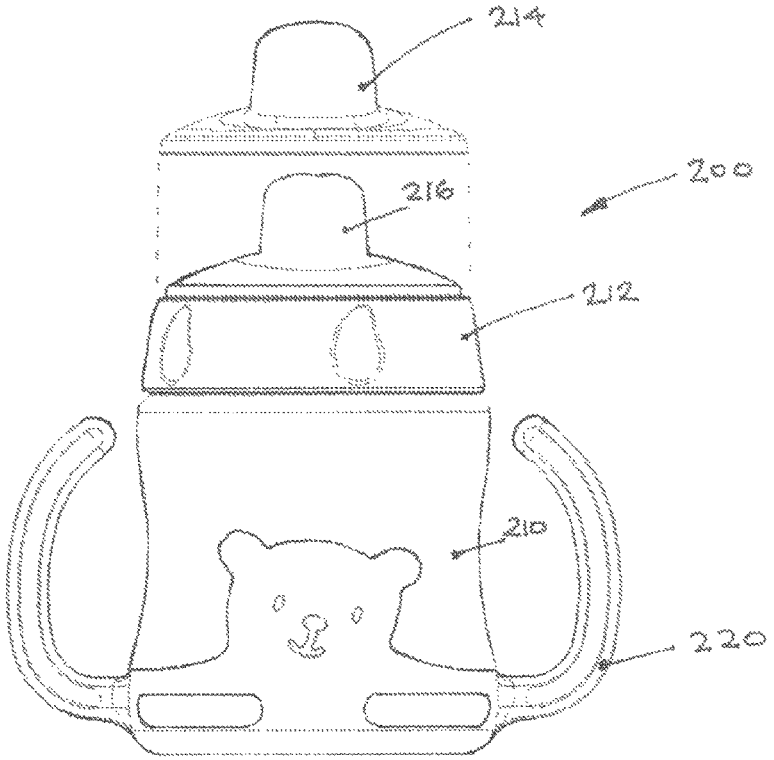
FIG. 1 shows a side orthographic view of a non-spill drinking vessel, lid assembly and hygienic cover according to an embodiment of the invention.
Figure 1A:
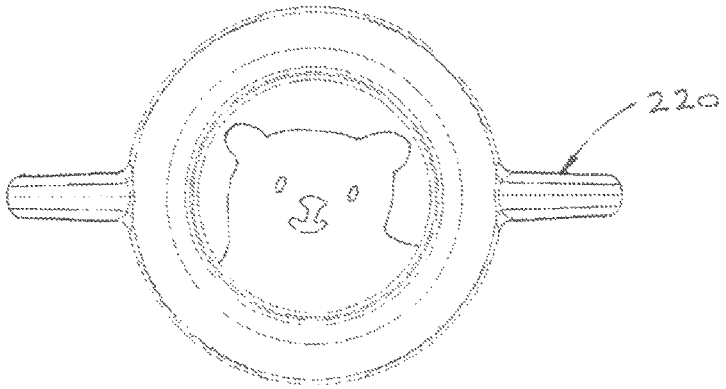
FIG. 1A shows a bottom orthographic view of the drinking vessel of FIG. 1.
Figure 15:
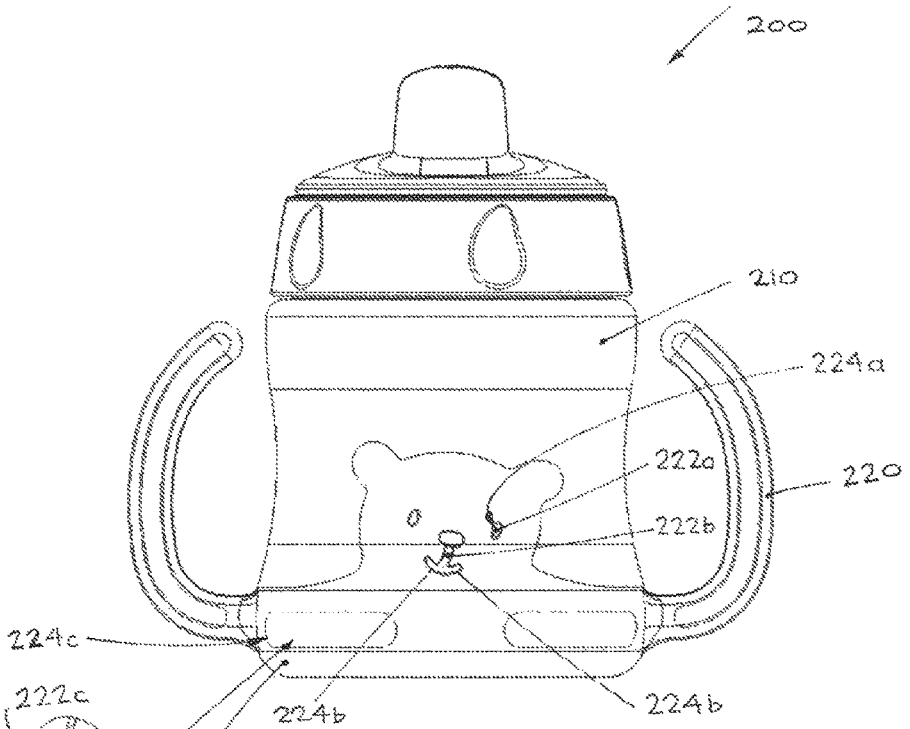
FIG. 15 shows a detailed view of the non-spill drinking vessel of FIG. 1.
Figure 16:
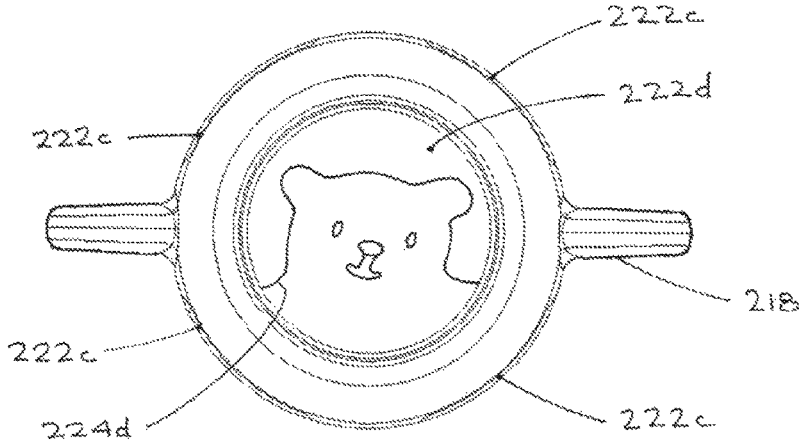
FIG. 16 shows a bottom orthographic view of the drinking vessel of FIG. 15.

A further embodiment of this invention relates to a non-spill drinking vessel 200 of FIGS. 1 and 1A, as described in more detail in relation to FIGS. 15 and 16. The non-spill drinking vessel 200 comprises a cup base 210 and the non-spill drinking cup valve system 10, 100 as described in any previous embodiment. In particular, the lid assembly 212 may comprise the flexible valve member 14, 114, either with or without the retaining member 34, as is described above.

The configuration as further described below provides for a hygienic construction of the cup, and provides a construction that reduces component parts.

FIGS. 1, 15 and 16 show a non-spill drinking vessel 200 comprising a cup base 210 that is preferably secured by means of a screw thread to the lid assembly 212. Other suitable means to secure the lid assembly 212 to the cup base 210, such as a push-fit or a clip-fit arrangement, may be used for spouted cups for the elderly and infirm. The non-spill drinking vessel 200 may also comprise a hygiene cover 214 and cup base frame 218 having handles 220.

Figure 15A:
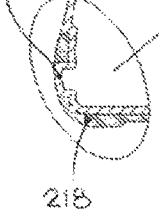
FIG. 15A shows an enlarged orthographic view of the drinking vessel of FIG. 15.

As shown best in FIGS. 15, 15A and 16, the cup base 210 may comprise protrusions 222*a*, 222*b*, 222*c*. The base frame 218, which may be injection moulded, may comprise handles 220 and apertures 224*a*, 224*b* and 224*c* that correspond to protrusions 222*a*, 222*b* and 222*c* respectively. The protrusions 222*a*-*c* of the cup base 210 mate with the corresponding apertures 224*a*-*c* of the base frame 218 (see FIG. 15A) to provide a secure fit between the cup base 210 and the base frame 218.

FIG. 16 shows the protrusions 222*c* of the cup base 210 and additional protrusion 222*d* on the underside of the cup, which engage with a corresponding aperture 224*d* of the cup base frame 218.

This arrangement provides a very strong, impact resistant, cup base construction. Since the cup base frame 218 is fixedly engaged with the cup base 210, the resulting assembly is also hygienic, as any potential contamination between the mating faces between the cup base 210 and the base frame 218 is prevented.

A further enhancement to the strength of the assembly of the cup base frame to the cup body is possible by blending the polyolefin material used for the cup base frame 218 with thermo-plastic elastomer (TPE) since this, when heated as part of the manufacturing process, will provide a level of bonding at the interface between the cup base frame 218 and the cup base 210.

Figure 17:
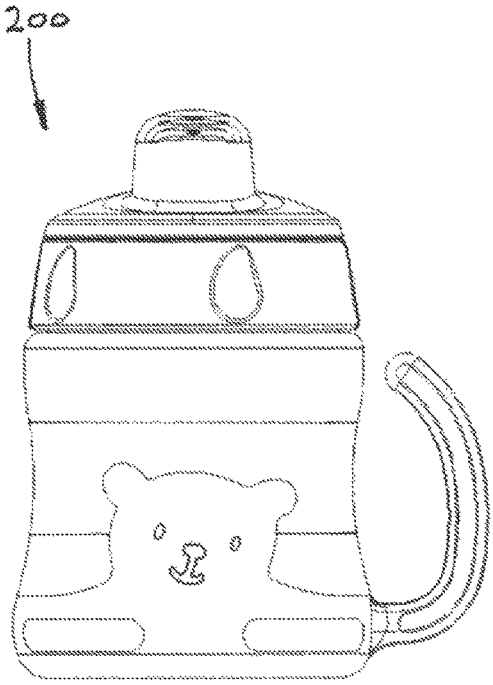
FIG. 17 shows a side orthographic view of another non-spill drinking vessel and lid assembly according to FIGS. 15-16.
Figure 18:
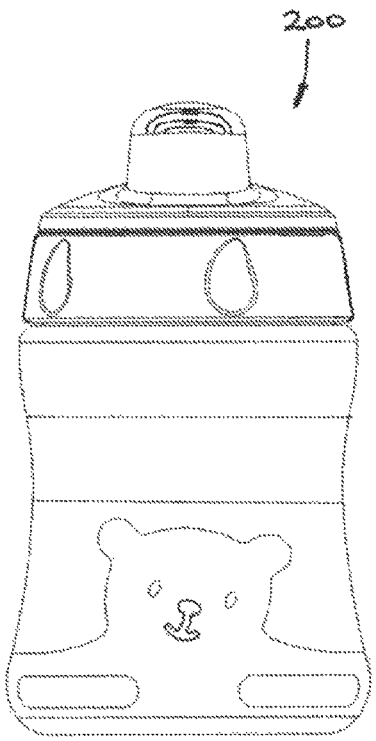
FIG. 18 shows a side orthographic view of yet another non-spill drinking vessel and lid assembly according to FIGS. 15-16.

FIGS. 17 and 18 show a non-spill drinking vessel 200 with one handle 220 and no handles respectively.

Figure 19:
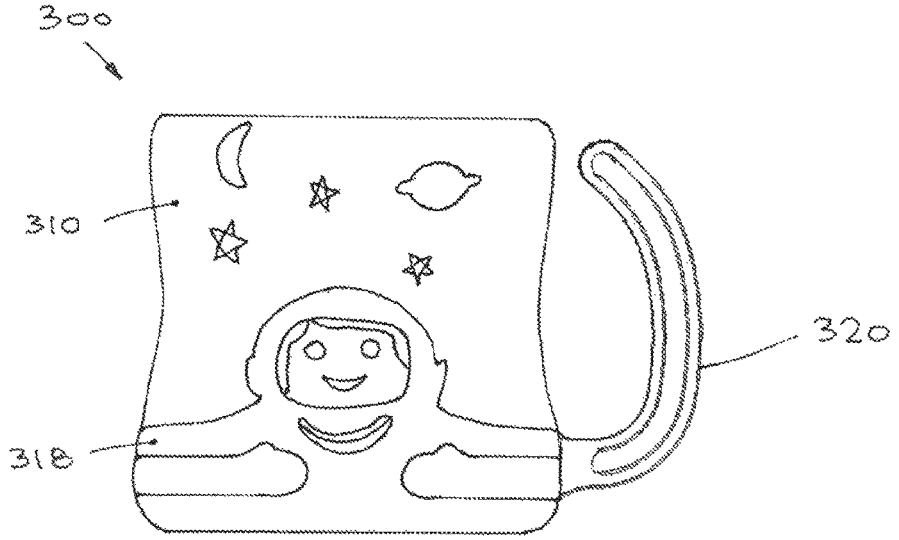
FIGS. 19 and 20 show side orthographic views of a non-spill drinking vessel in accordance with yet another embodiment of the invention.
Figure 20:
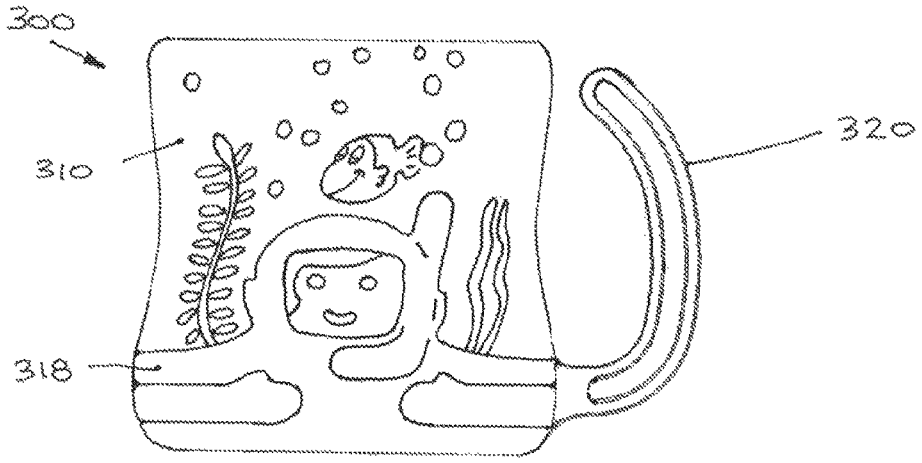

FIGS. 19 and 20 shows another embodiment of a non-spill drinking vessel 300 comprising a cup base 310, a cup base frame 318 and a handle 320. The non-spill drinking vessel 300 also may comprise a non-spill drinking cup valve system 14, 114 as described in any previous embodiment (not shown).

Figure 21:
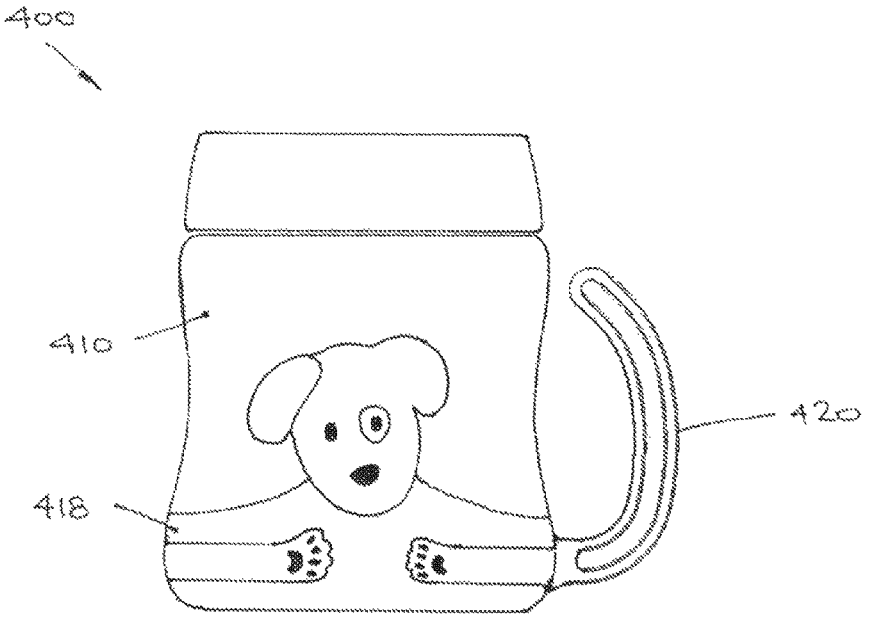
FIGS. 21 and 22 show side orthographic views of a non-spill drinking vessel in accordance with another embodiment of the invention.
Figure 22:
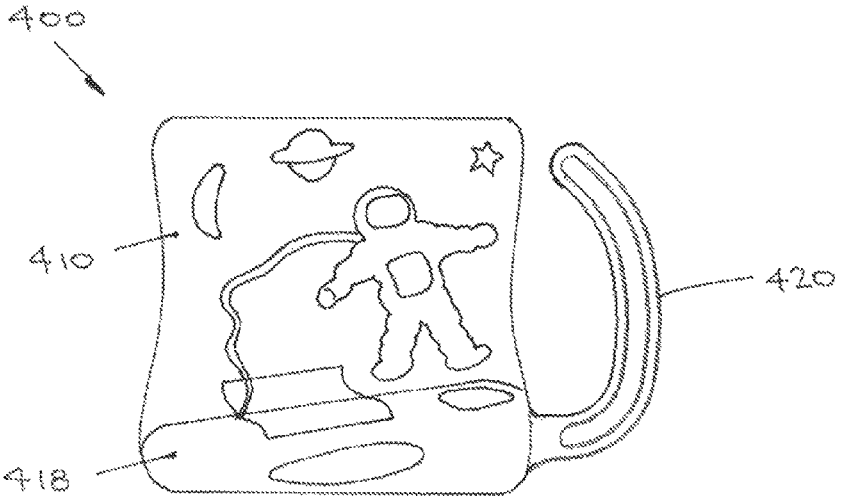

FIGS. 21 and 22 show yet another embodiment of a non-spill drinking vessel 400 comprising a cup base 410, a cup base frame 418 and a handle 420. The non-spill drinking vessel 400 may also comprise a non-spill drinking cup valve system 14, 114 as described in any previous embodiment (not shown).

The materials for the cup base 210, 310, 410, the lid assembly 12, 212, the retaining member 34, the hygiene cover 214 and the handles 220, 320, 420 are preferably made by an injection moulding process from food contact approved thermoplastic polyolefins. Suitable polyolefins include polypropylene (PP), polyethylene (PE) or a combination thereof, as they provide the optimum desirable properties i.e., strength, toughness, impact resistance, durability, clarity, surface finish and are Bisphenol-A free.

The flexible valve member 14, 114 preferably comprises a suitable food contact-approved flexible material. For example, the flexible valve member 14, 114 may comprise silicone and is manufactured by a silicone liquid injection moulding (LIM) or silicone compression moulding (CM) process. In another example, the flexible valve member 4 comprises thermoplastic elastomer (TPE) and is manufactured by means of injection moulding. Preferably, the flexible valve member 14, 114 has a 'Shore A' hardness between 20 and 50 as this provides optimum results for ease of drinking and sealing.

It will be appreciated for persons skilled in the art that the above embodiments have been described by way of example only and not in any limiting sense and that various alterations and modifications are possible without departing from the scope of the invention as defined by the appended claims.

The invention claimed is:

1. A non-spill drinking cup valve system comprising:

a lid assembly and a flexible valve member, wherein the flexible valve member is removably attachable to the lid assembly, the lid assembly comprising a spout having a drinking aperture therein, the spout being generally elongate with a generally rounded or convex tip;

the flexible valve member comprising a protruding member having a generally rounded or convex tip and a drinking valve element slit in the form of a valve slit that extends along a length in the generally rounded or convex tip, which, in use, controls fluid flow into the spout and out of the drinking aperture, wherein the protruding member and the spout are of a complementary shape and, when the lid assembly and the flexible valve member are attached together, the protruding member extends substantially into the spout, the profile of the outer surface of the protruding member following the profile of an inner surface of the spout, such that there is a minimum clearance between the outer surface of the protruding member and the inner surface of the spout, this clearance is necessary to allow the valve slit to open in the clearance when suction is applied to the spout, the clearance is kept to a minimum and is substantially only as wide as required for the valve slit to open, to reduce the potential volume of liquid which may become trapped between the flexible valve member and the spout when drinking;

wherein the generally rounded or convex tip of the protruding member has an outwardly curved profile in a cross sectional plane passing through the length of the valve slit and the drinking aperture of the spout and the generally rounded or convex tip of the protruding member also has an outwardly curved profile in a cross sectional plane passing perpendicularly through the length of the valve slit and through the drinking aperture of the spout.

2. The non-spill drinking cup valve system of claim 1, wherein the drinking valve slit opens in a direction of an applied suction when a user applies suction to the spout.

3. The non-spill drinking cup valve system of claim 2, wherein the drinking valve slit opens under a suction of less than 50 mbar.

4. The non-spill drinking cup valve system of claim 3, wherein the drinking valve slit opens under a suction of 15-40 mbar.

5. The non-spill drinking cup valve system of claim 1, wherein the drinking valve slit of the flexible valve member is between 5-10 mm in length.

6. The non-spill drinking cup valve system of claim 1, wherein the flexible valve member further comprises one or more compression pads, wherein the one or more compression pads engage an inner wall of the spout such that, when suction is applied to the drinking aperture, the flexible valve member distorts about the one or more compression pads to open the valve slit.

7. The non-spill drinking cup valve system of claim 1, wherein the lid assembly comprises a locating boss, the flexible valve member comprises a boss receiving member and, when the lid assembly and the flexible valve member are attached together, the boss receiving member frictionally engages the locating boss.

8. The non-spill drinking cup valve system of claim 7, wherein the locating boss has a venting aperture located therein and the boss receiving member comprises a venting valve element which, when the lid assembly and the flexible valve member are attached together, is in fluid communication with the venting aperture.

9. The non-spill drinking cup valve system of claim 8, wherein the venting valve element is a venting valve slit.

10. The non-spill drinking cup valve system of claim 1, further comprising a valve retaining member.

11. The non-spill drinking cup valve system of claim 1, wherein the lid assembly comprises one or more posts and the flexible valve member comprises one or more corresponding holes for receiving the posts thereby to locate the flexible valve member.

12. The non-spill drinking cup valve system of claim 1, wherein the flexible valve member further comprises a flexible lip seal, wherein the flexible lip seal engages an inner surface of the lid assembly to form a seal when the flexible valve member is assembled to the lid assembly.

13. The non-spill drinking cup valve system of claim 1, wherein the flexible valve member further comprises a rib that forms a seal with the inner surface of the spout.

14. The non-spill drinking cup valve system of claim 1, wherein the flexible valve member further comprises an integral removal tab.

15. The non-spill drinking cup valve system of claim 1, wherein the flexible valve member comprises silicone or thermoplastic elastomer.

16. The non-spill drinking cup valve system of claim 1, wherein the flexible valve member has a Shore A hardness between 20 and 50.

17. The non-spill drinking cup valve system of claim 1, wherein the lid assembly comprise a food-contact approved thermoplastic polyolefin.

18. The non-spill drinking cup valve system of claim 17, wherein the food-contact approved thermoplastic polyolefin comprises polypropylene, polyethylene, or a combination thereof.

19. A non-spill drinking vessel comprising the drinking cup valve system of claim 1 and a cup base.

20. The non-spill drinking vessel of claim 19, wherein the lid assembly and the cup base are secured by a screw thread.

21. The non-spill drinking vessel of claim 19, wherein the lid assembly and the cup base are secured by a push-fit or clip-fit.

22. The non-spill drinking vessel of any of claim 19, wherein the cup base comprises a handle.

* * * * *